United States Patent [19]

McCullion, Jr.

[11] 4,421,026

[45] Dec. 20, 1983

[54] PROCESS COLOR OFFSET PRINTING DUPLICATOR

[75] Inventor: Francis E. McCullion, Jr., Colts Neck, N.J.

[73] Assignee: Cymaticolor Corporation, Edison, N.J.

[21] Appl. No.: 254,456

[22] Filed: Apr. 15, 1981

[51] Int. Cl.[3] ..... B41F 7/06; B41F 21/12; B41F 21/14

[52] U.S. Cl. ..... 101/136; 101/137; 101/242; 101/415.1; 101/217; 101/DIG. 12

[58] Field of Search ..... 101/136, 137, 141, 142, 101/144, 152, 177, 183, 184, 115, 154, 215, 217, 251, 232, 233, 239, 241, 242, 183, DIG. 12, 415.1

[56] References Cited

U.S. PATENT DOCUMENTS

| | | | |
|---|---|---|---|
| 1,949,001 | 2/1934 | Albrecht | 101/183 |
| 2,138,407 | 11/1938 | Huck | 101/183 |
| 2,245,343 | 6/1941 | Hunting | 101/136 |
| 2,821,911 | 2/1958 | Mestre | 101/144 |
| 2,845,860 | 8/1958 | Mestre | 101/177 |
| 2,846,220 | 8/1958 | Mestre | 271/31 |
| 2,859,692 | 11/1958 | Mestre | 101/217 |
| 2,890,884 | 6/1959 | Mestre | 271/56 |
| 2,896,535 | 7/1959 | Schünemann | 101/152 |
| 2,899,202 | 8/1959 | Mestre | 271/53 |
| 2,911,907 | 11/1959 | Davidson | 101/183 X |
| 2,915,970 | 12/1959 | Mestre | 101/144 |
| 2,929,321 | 3/1960 | Nebegin | 101/364 |
| 3,007,737 | 9/1961 | Barnhart | 96/30 |
| 3,103,880 | 9/1963 | Sanford et al. | 101/136 |
| 3,221,651 | 12/1965 | Tagliasacchi | 101/183 |
| 3,381,612 | 5/1968 | Lecha | 101/211 X |
| 3,516,355 | 6/1970 | Giuiuzza | 101/183 |
| 3,527,164 | 9/1970 | Bulk | 101/137 |
| 3,812,779 | 5/1974 | Cobb | 101/115 |
| 3,926,118 | 12/1975 | Preuss | 101/136 X |
| 3,949,670 | 4/1976 | Katsuji | 101/177 |
| 4,111,120 | 9/1978 | Paulson | 101/175 |

FOREIGN PATENT DOCUMENTS

| | | | |
|---|---|---|---|
| 2006113 | 5/1979 | United Kingdom | 101/230 |

*Primary Examiner*—J. Reed Fisher
*Attorney, Agent, or Firm*—Gottlieb, Rackman & Reisman

[57] ABSTRACT

A process color offset duplicator uses a plurality of duplicator heads arranged serially to print full process color. The duplicator heads are adapted to apply a thin layer of ink onto plates held on their respective plate cylinders, in order that plate cylinders which are prepared using a dot screen can be used. The plate cylinders further include registration pins, whereby tha various ones of said plates can be mounted in relative alignment on different ones of said plate cylinders.

17 Claims, 6 Drawing Figures

PROCESS COLOR OFFSET PRINTING DUPLICATOR

BACKGROUND OF THE INVENTION

The present invention relates to an offset duplicator. In particular, the invention relates to an offset duplicator which is capable of process color offset printing.

The printing industry has reached high levels of sophistication over the past several years as many businesses and other fields have placed increasingly greater demands on the quality of their printed materials. From the industry's early beginnings in straightforward black-and-white reproduction, printing has followed a gradual development in terms of techniques, quality, and output which has led to the current state of the printing art. Users of printed materials cover a wide range of interests and fields. Virtually every commercial and noncommercial entity uses the print media for a variety of purposes.

In order to satisfy the need for printed materials a wide variety of printing apparatus has been developed. Such equipment has typically been developed to satisfy particular printing needs. Thus a typewriter may be used to provide a single, high quality copy, but it would not generally be used if a number of copies were required. In such cases, a photocopier would typically be used to provide a relatively limited number of high quality copies, whereas a mimeograph machine or a spirit copier might be used to provide a relatively limited number of less expensive, but poorer quality, copies.

When large numbers of high quality copies are required, some type of offset printing equipment is typically used. The features desired by a particular user largely determine the particular type of printing equipment required for use on a job. Thus, a user of a large number of copies, who did not need to reproduce full color items, would conventionally use an offset duplicator.

As used herein, the term "full color" refers to items which include arbitrary colors, such as photographs, rather than items which may include a plurality of colors, such a line copy. While line copy may be printed in multiple colors, the separation processes required for "full color" or "process color" printing are not needed.

When factors such as printing in full color, cost per copy, number of copies per plate, and speed of operation are critical, as they are in a large printing operation, the type of equipment available to perform the required services becomes limited, and the cost of such equipment becomes quite large. For example, to fill the need for printing a large number of items in full color, the only printing equipment heretofore available has been the rotary offset printing press. Such equipment is capable of producing a fine quality product and is the type of equipment which is generally used to print full color.

Rotary offset color presses of the type in common use include many features which insure that they will have a very high quality product. Unfortunately, these items result in a very high acquisition cost. By way of example, in order to be able to spread a thin layer of ink onto the printing plate used in such a press, a so-called "tower" is located over each plate cylinder the press. Within that tower, there are typically more than fifty ink rollers. Their purpose is to thin out the viscous ink used in printing. A very thin layer of ink is required on the printing plate, because the plate used for each color is comprised of a very dense arrangement of dots. Those skilled in the art recognize that in a full color or "process color" printing press, the original item to be reproduced first undergoes a "color separation" procedure in which the colors of the original are separated into constituent colors which, when recombined, result in the colors of the original. Each of the constituent colors is printed separately. The physical separation is accomplished through the use of a screen having a very dense pattern of dots. The higher the dot density, the closer together the different colored dots will be on the ultimate print, and consequently the higher the resolution of the ultimate print.

Thus, the rotary offset color presses heretofore known have had to include a mechanism for insuring that when a high dot density screen is used in preparing the printing plates, i.e. one typically having from about 150 to about 200 dots or "lines" per inch, the ink applied to the plates will not fill in the spaces between the image dots. As should be obvious, if the ink layer were not applied to the plate as a very thin film, a muddled print would result.

Naturally, the preparation of the plates with the high resolution described above, the so-called "high etch" plates, involves a very exacting and precise process. This further increases the expense of producing high quality printed output on an offset press.

An additional feature of the conventional rotary offset color press is the use of so-called "transfer cylinders" to move sheets of paper from one print head to another. The transfer cylinders insure very accurate registration of sheets of paper at different locations within the press. Such registration is required in order to insure accurate color reproduction.

Unfortunately, there have been a variety of applications in which color printing has heretofore been desirable, but too costly, due to the cost of conventional color offset printing presses. The user who has not needed absolutely accurate color reproduction could not heretofore find a machine capable of process color offset printing, providing relatively good color, simple operation, and inexpensive purchase and maintenance costs.

In addition, the cost of setting up a job for a conventional rotary offset color press has been so high that it has not heretofore been economical to print small jobs in full color. Thus, the user who needs a relatively small number of color copies, i.e. less than about 2500 copies, has typically found it too expensive to have the job run by a print shop.

Instead, the user of a relatively small number of copies has been limited to a much less expensive device, such as an offset duplicator, and has had to give up color reproduction. The term "duplicator" is used herein to refer to printing equipment of the type described more fully in U.S. Pat. No. 2,821,911 entitled INTERRUPTER FOR ROTARY OFFSET PRINTING MACHINE; U.S. Pat. No. 2,846,220 entitled SHEET FEEDER FOR PRINTING PRESS; U.S. Pat. No. 2,859,692 entitled SHEET DELIVERY MEANS FOR ROTARY OFFSET PRINTING PRESSES; U.S. Pat. No. 2,890,884 entitled MULTIPLE SHEET EJECTING MECHANISM; U.S. Pat. No. 2,899,202 entitled OFFSET PRINTING MACHINE AND SHEET GAGE; U.S. Pat. No. 2,915,970 entitled INKING AND DAMPENING MEANS FOR AN OFFSET PRINTING MACHINE; and U.S.

Pat. No. 2,929,321 entitled INK FOUNTAIN ROLL. Each of the foregoing U.S. patents is incorported herein by reference.

While an offset duplicator is an offset printing apparatus, and it uses many of the same principles as the rotary offset color press described above, it is not designed for process color printing. Thus, while more than one color may have heretofore been printed on a single item using an offset duplicator, as described more fully in U.S. Pat. No. 2,845,860 entitled TWO-COLOR OFFSET PRINTING PRESS, full color printing on an offset duplicator has not been accomplished heretofore. In other words, the different colored inks were not separated by a color separation process, because an offset duplicator is inherently incapable of providing the fine ink layer on a plate and the accurate sheet transfer that the rotary offset color press is designed for. Heretofore, no one had designed a color separation printing process which could be used in an offset duplicator to bring its simplicity, and lower price, to the public.

SUMMARY OF THE INVENTION

A process color offset printing duplicator manufactured in accordance with the present invention includes a plurlity of offset duplicator heads, each of which prints a single color onto a single piece of sheet stock. The duplicator heads are arranged serially, such that the print output of the first duplicator head is fed into the second duplicator head for printing the second color. Using a novel color subtractive process designed to compensate for the inherent limitations of an offset duplicator, plates for the process color offset printing duplicator of the present invention can be constructed. In one embodiment of the invention, three print heads, which print cyan, yellow, and magenta, are used. A preferred embodiment of the invention would include a fourth duplicator head which prints black, in order to increase the contrast of the final product.

DETAILED DESCRIPTION OF THE PREFERRED EMBODIMENT

Figure 1:
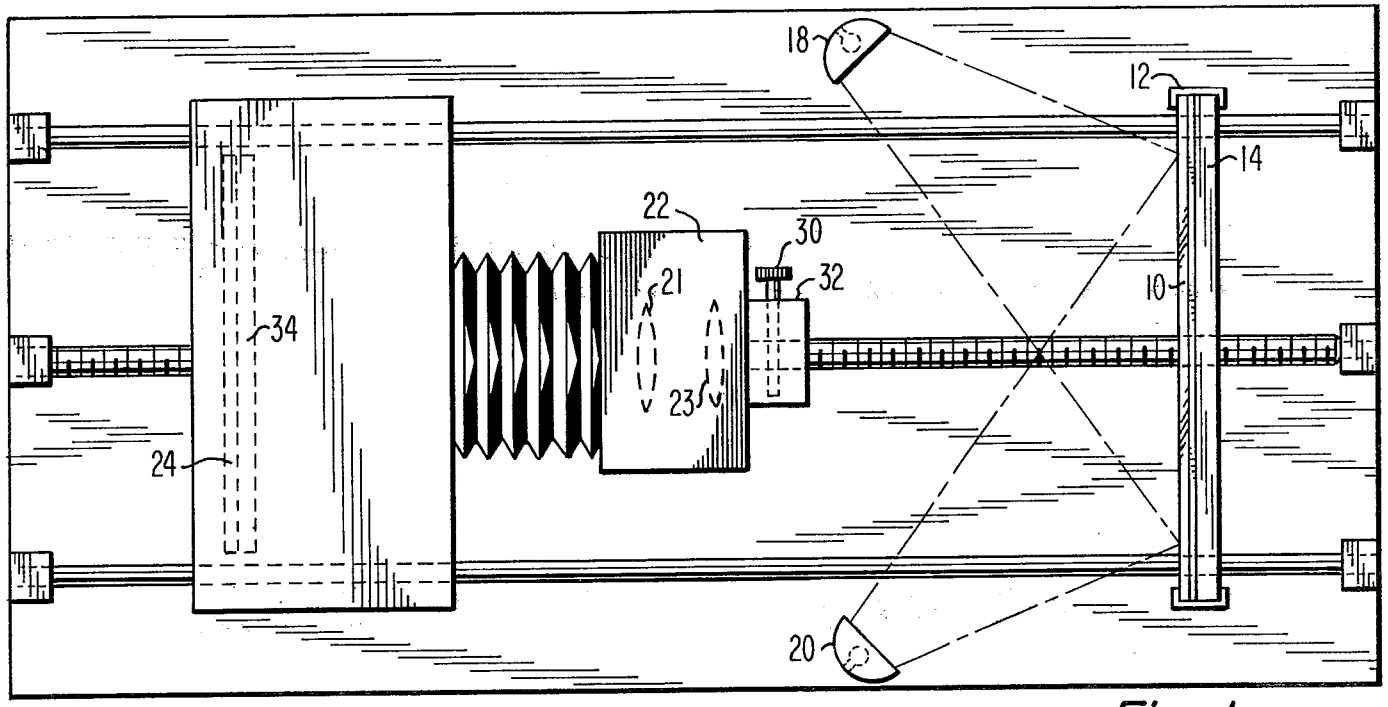
FIG. 1 is an illustration of the equipment used to expose the negatives which are used to make the plates required for use with the process color offset printing duplicator of the present invention.
Figure 2:
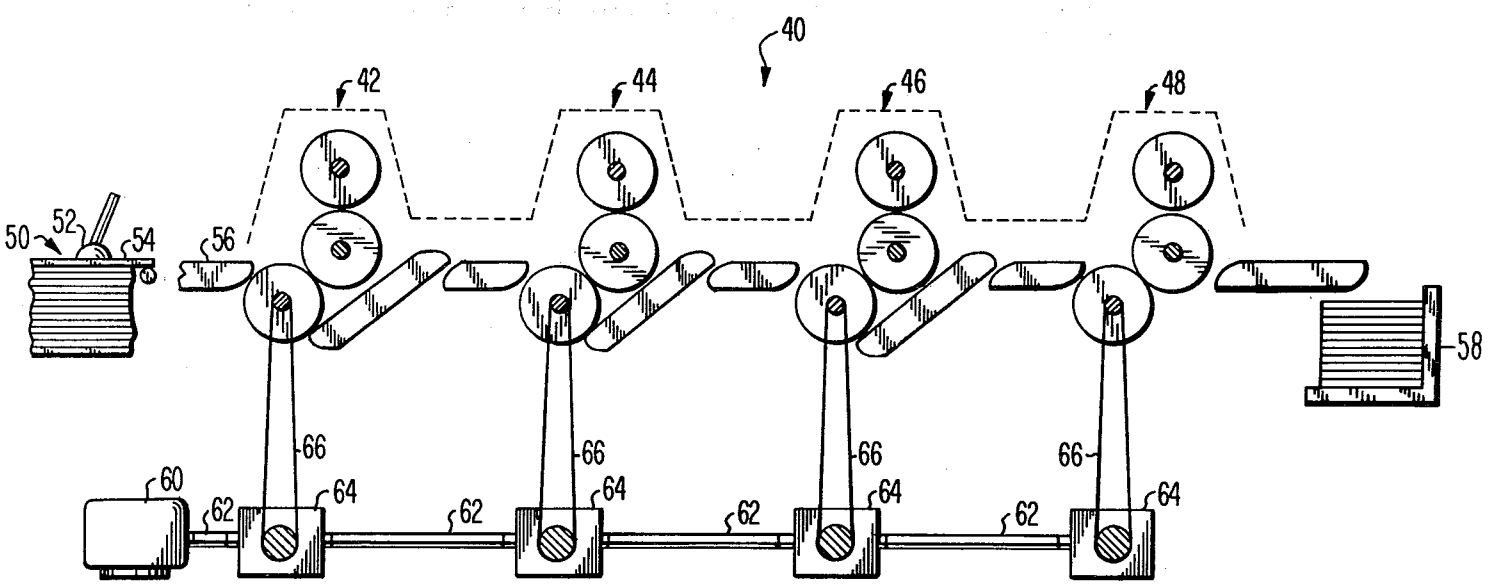
FIG. 2 is a side view of the process color offset printing duplicator of the preferred embodiment of the invention with much of the detail removed for clarity.

In accordance with the present invention, a process color offset printing duplicator 40, is shown in FIG. 2. The process color offset printing duplicator 40 includes a plurality of duplicator heads 42, 44, 46, 48 to provide good quality color prints. In order to accomplish that result, a series of plates, each of which is used as an offset plate in a particular one of the duplicator heads, must first be produced. Accordingly, while the present invention is a process color offset printing duplicator, in order to gain a complete and proper understanding of the invention, reference must first be made to FIG. 1 which illustrates the method of preparing the plates, i.e. the so-called "color separation" process, used in the process color offset printing duplicator 40 of the present invention.

Referring to FIG. 1, the color separation process begins with an object 10, which may be line copy, artwork, a photograph, a half-tone, or some similar object, placed into a holder 12 on a copyboard 14. The object 10 is affixed with appropriate registration indices in order to permit the ultimate registration of elements, such as acetate elements, which are used in a proofing step, or printing plates, which are used in the ultimate duplicating step.

Typically, the object 10 is illuminated by at least two remotely spaced light sources 18, 20. Light reflected from the object 10 is collected by an optical system 22, which includes lenses 21, 23, or a similar device which must be capable of focusing the reflected light onto a series of planar elements, each of which will be referred to by reference numeral 24. The original planar element 24 which is used is a ground glass plate on which the image of the object 10 is brought into focus. Then, the ground glass plate is replaced by a film holder 24 which is adapted to hold a sheet of sensitive panchromatic film. For example, if a three-color process, without black ink for contrast, is being used, the panchromatic film must be sensitive to the colors which will be used in the process. Typically, in a three-color process, the inks used will be cyan, yellow, and magenta. Accordingly, the film used to prepare the duplicator plates must be sensitive to the "negatives" of those colors, i.e. red, blue, and green. Kodak Graphic Arts Film, No. 2568, has been found to be suitable for use in this process.

In order to expose each of the three sheets of film needed for the three plates, a film sheet is placed into the film holder 24 and a filter 30 is placed into a filter holder 32 in the path of the light being reflected by the object 10. In addition, a pre-angled dot screen 34 is typically placed in front of the film holder 24 in order to improve the visual clarity and definition of the ultimate image.

Continuing with the present example, a series of three exposures will be made. Since the focusing has already been achieved using the ground glass element, no further focusing is required when the ground glass element is replaced by the film holder as the planar element 24. A pre-angled dot screen 34, which typically comprises an array of elliptical dots with a density of from about 120 to 150 dots per linear inch, is placed in contact with the sheet of film in the film holder 24, such that each sheet of film will be exposed through the dot screen 34. The dot density of the screens used to prepare each of the negatives in a particular process must, of course, be identical.

The step of preparing the negative for the cyan plate proceeds with a red filter 30, such as a Kodak No. 25 filter, in the filter holder 32. Depending upon the object being copied, varying light intensities, lens openings, and exposure times may be used. In a typical exposure, a light intensity of about 64,000 foot candles is present at the optical system 22, and a lens opening of f/22 is used. A typical exposure time for preparing the negative for the cyan plate is about 50 seconds. Typically, the angle of dots on the dot screen 34 will be 105 degrees.

Similarly, the step of preparing the negative for the yellow plate proceeds with a blue filter 30, such as a Kodak No. 47 filter, in the filter holder 32, an exposure time of about 60 seconds, and a dot screen angle of 90 degrees; and the step of preparing the negative for the magenta plate proceeds with a green filter 30, such as a Kodak No. 58 filter, in the filter holder 32, an exposure time of about 70 seconds, and a dot screen angle of 75 degrees. If additional contrast is desired, a black printing plate can be utilized in addition to the three plates already described. The negative for the black printing plate can be prepared using a yellow filter 30, such as a Kodak No. 8 filter, in the filter holder 32, an exposure time of about 25 seconds, and a dot screen angle of 75 degrees.

Following the separate exposure steps, each film sheet is developed in a high quality developer, such as Naccolith 611, with the operator carefully monitoring the gradually darkening Stouffer scale. Depending upon the desired output, varying darkening stages can be used. In a typical process, the developing will be stopped, using a stop bath, when the No. 1 dot on the Stouffer scale becomes solid black. This is a useful guide for evaluating the exposure time needed by each of the exposure steps. The negative is then fixed, washed, and dried in accordance with standard photographic processes.

Next, appropriate masking sheets for the three colors used in the process are aligned using the registration indices that had been placed on the original artwork. A so-called "proofing" step, to determine the precise color quality of each negative can be accomplished, if desired. Such a step involves mounting each negative on a color key sheet and photographically preparing a separate color keyed member, or acetate, for each of the negatives. Thereafter, the acetates are mounted in layers and registered with respect to each other, and the relative color content of the composite product is tested. If any color revisions are needed, they may be done at this point in the process. However, for the purpose of explaining the present invention, it suffices to say that these steps may be accomplished, if desired.

For each of the negatives, a suitable plate, of the type used in subtractive printing processes, is prepared. The preparation of each plate involves exposing the plate through one of the negatives, such that the exposing light removes or "burns" away all of the plate's surface, except where the negative image is located. In those locations, the material used for the ultimate contact printing step will remain. An exposure step is accomplished for each of the negatives in order to produce a plate which is used in the process color offset printing duplicator of the present invention. As will be obvious to those skilled in the art, the step of preparing the plates is identical to the proofing step described above, except that the plates are not transparent and the acetates are.

Referring now to FIG. 2, the process color offset printing duplicator 40 is shown. The preferred embodiment of the process color offset printing duplicator 40 comprises a series of four duplicator heads 42, 44, 46, 48. As used herein the term "duplicator head" refers to the portion of a duplicator machine, of the type heretofore known, which does the actual printing of ink onto a sheet of stock fed through the process color offset printing duplicator 40. The process color offset printing duplicator 40 further comprises a sheet feeding mechanism 50, of the type well known in the art. The sheet feeding mechanism 50 includes a suction feeder 52 which lifts sheets of paper 54 and places them on a first delivery table 56. The printing process involves printing a separate ink color on each sheet in each of the duplicator heads 42, 44, 46, 48 in a manner to be explained hereinafter and then depositing the completed work into a hopper 58.

The process color offset printing duplicator 40 is driven by a motor 60, which turns a drive shaft 62. A series of transmission units 64 drive chains 66, and the chains 66 power the duplicator heads 42, 44, 46, 48. The duplicator heads 42, 44, 46, 48 are substantially identical, so a description of the first duplicator head 42, will serve to describe the elements of the other duplicator heads 44, 46 and 48.

Figure 3:
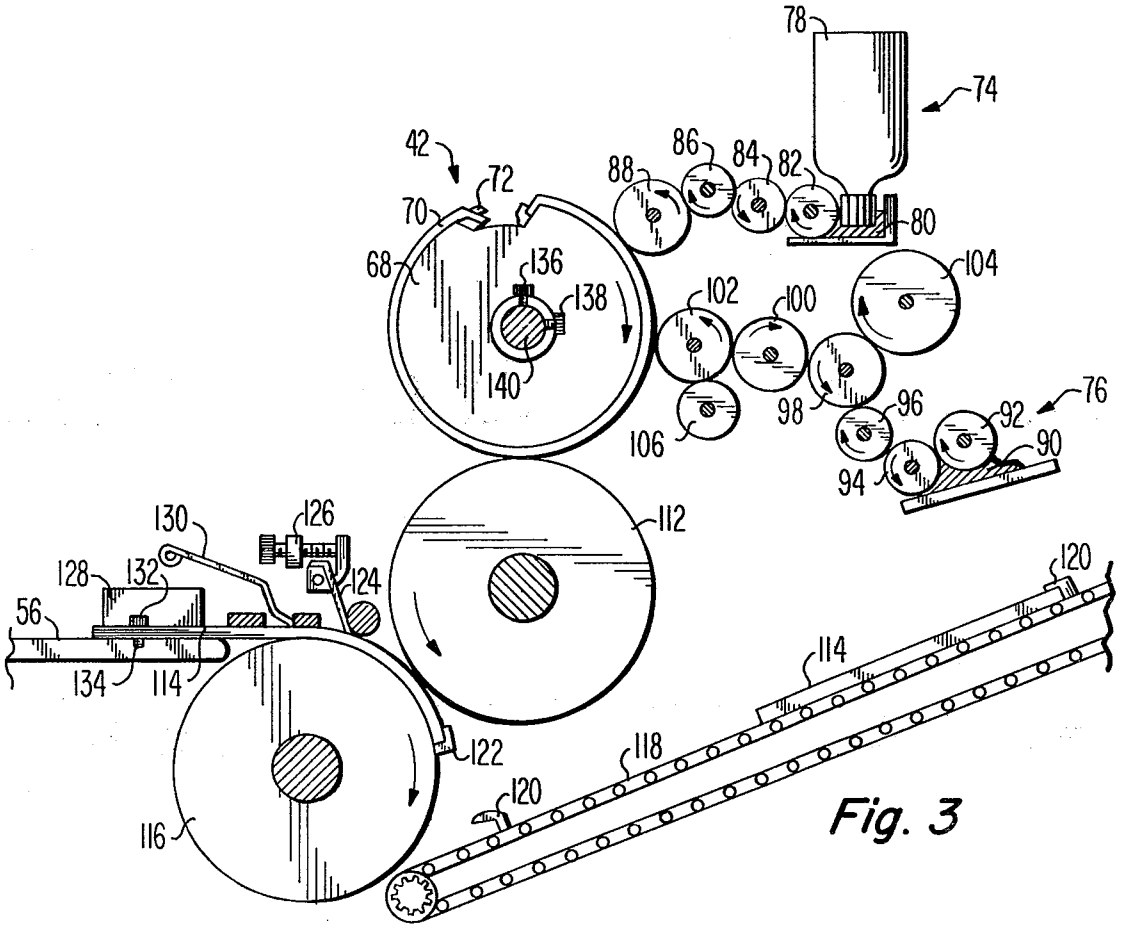
FIG. 3 is a side view of a duplicator head of the type used in the process color offset printing duplicator of the preferred embodiment of the invention.

Referring, therefore, to FIG. 3, the first duplicator head 42 comprises a plate cylinder 68, around which a first printing plate 70 is mounted by means of registration pins 72. The registration pins 72 are machined to fit registration holes formed in the plate 70. They differ from the holding pins normally found on standard offset duplicators in that the registration pins 72 are specifically fitted to the registration holes on the plate 70 without any play, whereas the holding pins of the prior art have a substantial amount of play in the holes which are preformed in standard plates. As will be understood by those of ordinary skill in the art, while the duplicator heads 42, 44, 46, 48 of FIG. 2 may be identical, in a typical printing operation, the plate 70, mounted on the first duplicator head 42, will be different from the plates mounted on the second, third, and fourth duplicator heads 44, 46, 48.

With continued reference to FIG. 3, the first duplicator head 42 further comprises a water supply 74 and an ink supply 76. The water supply 74 comprises a reservoir, such as the inverted bottle 78, which provides a flow of water 80 to water feed rollers 82, 84, 86, 88. The feeding roller 82 receives water 80 from the reservoir, and feeds it onto roller 84. Roller 84 feeds water onto roller 86, and roller 86 feeds water onto roller 88. Finally, roller 88 feeds water onto the plate 70.

The plate 70 is prepared in a manner, well known in the art, which makes its non-image portions, i.e. its non-printing portions, receptive to water, but not to grease or ink. Accordingly, the water 80 which roller 88 feeds onto the plate 70 will be received by the non-image portions of the plate 70.

Similarly, ink 90 from the ink supply 76 is fed onto the plate 70 by a series of ink feeding rollers 92, 94, 96, 98, 100, 102. Oscillator rollers 104, 106 serve to help spread the ink evenly over the ink feeding rollers. The plate 70 is, of course, prepared in a manner well known in the art, which makes its image portions, i.e. its printing portions, receptive to grease or ink, but not to water. Accordingly, the ink 90 which roller 102 ultimately feeds onto the plate 70 will be received by the image portions of the plate 70, but not by its non-image portions. Accordingly, the pressure of the final inking roller 102 upon the plate 70 must be light enough to prevent the roller 102 from forcing ink into the non-image areas of the plate 70. This light pressure between the final inking roller 102 and the plate 70 constitutes an important difference from what is found in duplicators of the type known in the prior art. In the present invention, the light pressure is designed to help to spread a thin film of ink 90 onto the plate 70. On the other hand, duplicators of the type heretofore known were not used for printing process color. Accordingly, they use a relatively high pressure between their final ink roller and their plate. In view of the fact that the plate used in a standard offset duplicator is not exposed through a dot screen of the type used for color separation, the high pressure is not a problem. When a standard offset duplicator is used for making half-tones, any extra ink imparted by the inking roller serves merely to degrade the half-tone image. However, in a color printing process of the type with which the present invention is used, any extra ink will prevent proper color printing from taking place.

Figure 4:
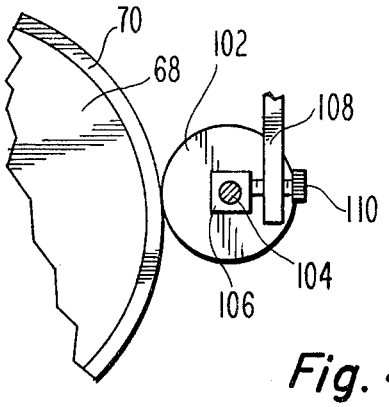
FIG. 4 is a side view of a portion of the adjustment used on the final ink feeding roller of the color offset printing duplicator of FIG. 2.

Referring to FIG. 4, the final ink roller 102 is shown. The final ink roller 102 rotates around a shaft 104. The shaft 104 passes through a housing 106 which is attached to a bracket 108 by means of a pressure adjustment means, such as adjustment screw 110.

Referring back to FIG. 3, the presence of ink 90 on the image portions of the plate 70 and water 80 on its non-image portions results in the transfer of an offset image, i.e. a reversed image, onto a blanket roller 112 which rotates in contact with the plate 70. A piece of sheet stock, such as a sheet of paper 114, which is fed into the duplicator head 42 on the first delivery table 56, will receive an inked image from the blanket roller 112. The sheet of paper 114 is held in contact with the blanket roller 112 by an impression cylinder 116 having a series of paper holding grippers 118. Following the printing of the image onto the sheet of paper 114, the sheet of paper 114 is moved by a feeding mechanism, such as a chain gripper apparatus 118, which includes grippers 120 which receive the sheet of paper 114 and transport it to the next delivery table (not shown).

As will be recognized by those skilled in the art, when a plurality of colors are printed in a full color process, the quality of the ultimate print will be determined to a large extent by the registration of the colors with respect to one another. In the process color offset printing duplicator 40 of the present invention, the two types of registration which are important are vertical registration and horizontal registration. The term "vertical registration" refers to the registration of the print along the vertical axis of a sheet of paper, whereas the term "horizontal registration" refers to the registration of the print along the horizontal axis of a sheet of paper.

Vertical registration is controlled by the timing of each sheet of paper 114 as it is grabbed by grippers 122, which are part of the impression cylinder 116, upon entering into each duplicator head. With continued reference to FIG. 3, a stop mechanism 124 at the end of the deliver table 56 receives each sheet of paper 114 before the sheet 114 is grabbed by the grippers 122 of the impression cylinder 116. The step mechanism 124 may include a micrometer adjustment 126, or similar means, for accurately aligning the top edge of the sheet 114, so that its position, as it is grabbed by the grippers 122, is accurately determined.

Horizontal registration is controlled by the side-to-side location of the sheet 114. Horizontal registration in an offset duplictor is typically controlled by a pair of paper guides, such as the guide 128 which is visible in FIG. 3. As each sheet 114 enters into the paper pick-up area adjacent the stop mechanism 126, its presence is signalled when it lifts a microswitch 130, causing the paper guides on either side of the sheet 114 totake action which aligns the sheet 114. In a standard duplicator, of the type heretofore known, the paper guides travel towards one another, thereby squaring up the sheet 114.

In the present invention, it is critical for horizontal registration to have one edge of each sheet of paper 114 located in the same relative position as it enters each of the duplicator heads 42, 44, 46, 48. Accordingly, the sheet guides are adjusted to urge each sheet of paper toward one side of the delivery table. That is preferably accomplished by using the type of sheet guides which include grippers 132, 134 to pull the paper 114 to one side of the delivery table 56, rather than the type which push each sheet toward the center of the delivery table. Alternatively, the sheet guides on one side of the delivery table can be adjusted so that they push each sheet much harder than the sheet guides on the opposite side of the delivery table. In any event, it is critical to horizontal registration to have one side of each sheet fixed in a known location as it enters each of the duplicator heads. The most accurate horizontal registration results from using paper guides which pull the sheet 114 to one side. However, if push guides are used, accurate horizontal registration can be obtained if one of the guides is either fixed in position or is adjusted to move with less force than the other guide.

As will be obvious to those skilled in the art, it is very important that the sheet 114 be properly aligned as it is picked up by the impression cylinder in each of the duplicator heads 42, 44, 46, 48. Accordingly, the paper guides and the stop mechanism in each duplicator head is independently adjustable.

In addition to the vertical alignment provided by the stop mechanisms and the horizontal alignment provided by the paper guides, additional features of the preferred embodiment of the invention which help to guarantee proper alignment include gross vertical alignment means, such as Allen screws 136, 138 which attach the plate cylinder 68 to its shaft 140. The Allen screws 136, 138 permit rotational movement of each of the plate cylinders of the various duplicator heads on their respective shafts in order to allow each plate cylinder to be registered with respect to each of the other plate cylinders. Once each plate cylinder is registers, it is fixed into position on its shaft. It is contemplated that this type of registration will be carried out when a machine is placed into service, and periodically thereafter, if necessary.

In order to accomplish the original alignment, a test sheet is printed with ink in the first and second duplicator heads 42, 44, and the plate cylinder in the second duplicator head 44 is aligned with respect to the plate cylinder in the first duplicator head 42. Then, the same thing is done with the plate cylinder in the third duplicator head 46, and, finally, with the plate cylinder in the fourth duplicator head 48. In that manner, the original vertical registration can be accomplished.

In addition to the original vertical registration, it is necessary to perform a "set up" or "make ready" for each print run. In the "set up", the stop mechanism for the sheets entering each duplicator head is adjusted in order to compensate for irregularities in the manner in which the sheets were originally cut, i.e. if they were not properly squared when cut. In addition, the horizontal adjustments, made using the paper guides, are performed.

Figure 5:
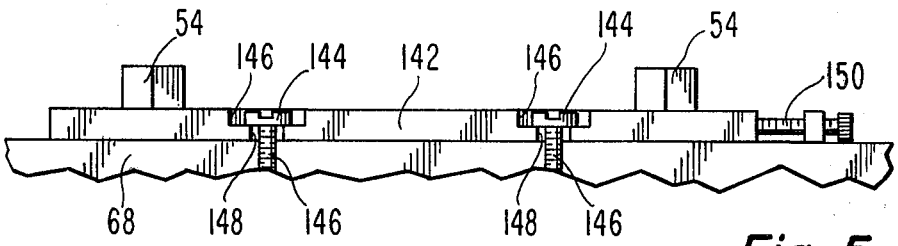
FIG. 5 is a side view of the registration plate used on the plate cylinder of the present invention.
Figure 6:
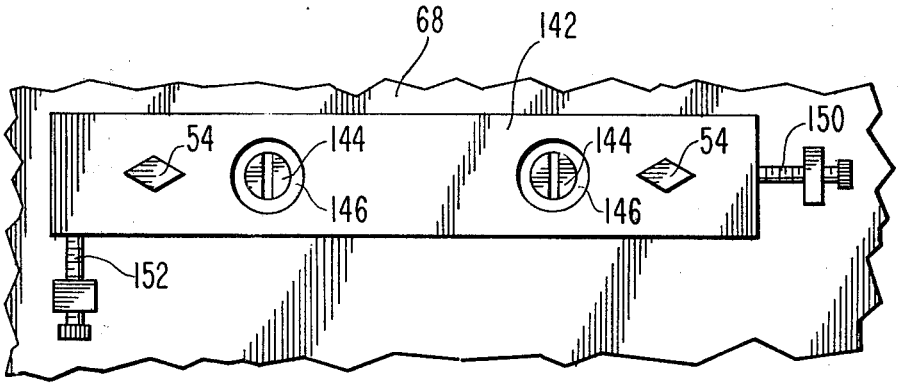
FIG. 6 is a top view of the registration plate shown in FIG. 5.

If further adjustment, i.e. to remove skew is required, a fine adjustment means, such as the micrometer adjustable registration plate 142, shown in FIGS. 5 and 6 is used. The registration plate 142 holds the registration pins 54. The registration plate 142 is attached to the plate cylinder 68 by means of screws 144 having shafts 146 narrower in diameter than holes 148 bored through the registration plate 142. The plate cylinder 68 is tapped to receive the screws 144, and the heads of the screws 144 are recessed into openings 146 formed in the surface of the registration plate 142. Micrometer adjustment means 150, 152 permit very fine adjustment of the registration plate 142 on the plate cylinder 68 when the screws 144 are loosened. After such adjustments are completed, the screws 144 are tightened to hold the registration plate 142 in the proper position for a particular run. For example, the micrometer adjustment means 150 is used for fine horizontal alignment, and the micrometer adjustment means 152 is used for fine vertical alignment. Together, they can be used to correct skew errors.

Synchronization of the various duplicator heads 42, 44, 46, 48 with respect to one another is important to prevent paper jams which would result if the duplicator heads 42, 44, 46, 48 did not rotate at the same rate. As shown in FIG. 2, the synchronization of rotation of the various duplicator heads 42, 44, 46, 48, with respect to one another, is assured through the use of chain drives 66 which rotate each of the parts of the various duplicator heads 42, 44, 46, 48 simultaneously when they are driven by a drive shaft 62, which in turn is driven by motor 60.

I claim:

1. A process color offset printing duplicator for printing an image in full color which comprises:

(a) means for feeding sheet stock onto a delivery table of a first duplicator head for effecting registration of said sheet stock;

(b) a plurality of serially arranged offset duplicator heads each of which includes a plate cylinder for holding a plate bearing said image, an impression cylinder, and a blanket cylinder having mounted thereon a blanket to receive said image from said plate cylinder, said impression cylinder adapted to bring a sheet of said stock into contact with said blanket to print a single color ink onto said sheet of said stock, (c) said serially arranged offset duplicator heads each having one of said delivery tables, a first one of said offset duplicator heads having means for receiving said sheet of said stock from said feeding means and delivering said sheet of said stock onto said impression cylinder of said first duplicator head, means on said impression cylinder for transferring said sheet to a first chain gripper, said first chain gripper including means for feeding said sheet onto one of said delivery tables of a second of said offset duplicator heads, each of said second, and subsequent ones of said offset duplicator heads further including corresponding ones of said delivery tables, sheet stock receiving and delivering means, transferring means and a chain gripper, said impression cylinder of a final one of said offset duplicator heads feeding said sheet of said stock onto a corresponding final one of said chain grippers, and registration means at each of said delivery tables for providing horizontal and vertical registration for the accurate application of said image to said sheet of said stock between each of said offset duplicator heads, and each of said offset duplicator heads including a water reservoir for holding water, means for delivering water from said water reservoir to said plate on said plate cylinder, an ink fountain for holding ink, and means for delivering ink from said ink fountain to said plate on said plate cylinder, said means for delivering ink being adapted to apply a relatively thin coat of ink onto said plate mounted on said plate cylinder.

2. The process color offset printing duplicator of claim 1 wherein said means for delivering ink comprises a series of ink rollers, a final one of which is adapted to contact said plate mounted on said plate cylinder with a pressure selected to apply a relatively thin coat of ink onto said plate.

3. The process color offset printing duplicator of claim 1 wherein said delivery tables include a set of guides which are each adapted to urge sheets thereon to one side of said delivery table, whereby said sheets enter into each of said duplicator heads aligned on the same side.

4. The process color offset printing duplicator of claim 3 wherein said guides are adapted to push each of said sheets to said one side of said delivery table.

5. The process color offset printing duplicator of claim 3 wherein said guides are adapted to pull each of said sheets to said one side of said delivery table.

6. The process color offset printing duplicator of claim 1 wherein the plate cylinder of each of said plurality of duplicator heads is adapted to hold said plate thereof in the same relative position as the plate cylinder of each of the other ones of said plurality of duplicator heads.

7. The process color offset printing duplicator of claim 6 comprising three duplicator heads which are adapted to print full color by printing cyan ink, yellow ink, and magenta ink.

8. The process color offset printing duplicator of claim 7 further comprising a fourth duplicator head adapted to print black ink.

9. The process color offset printing duplicator of claim 8 further comprising means for adjusting the position of said plate mounted on said plate cylinder.

10. The process color offset printing duplicator of claim 9 wherein said means for adjusting said plate mounted on said plate cylinder includes a registration plate.

11. The process color offset printing duplicator of claim 10 wherein said registration plate is adjustably affixed to said plate cylinder.

12. The process color offset printing duplicator of claim 11 including micrometer adjustment means to affix said registration plate to said plate cylinder.

13. A process color offset printing duplicator in accordance with claim 1 wherein said vertical registration means at each of said delivery tables includes means for temporarily stopping the forward edge of each of said sheets as it reaches said delivery table.

14. A process color offset printing duplicator in accordance with claim 13 wherein said stopping means includes an aligning surface for contacting said forward edge of each of said sheets to effect said stopping.

15. A process color offset printing duplicator in accordance with claim 14 wherein said stopping means further includes a head stopping mechanism and means for adjusting the vertical position of said mechanism along the longitudinal path of said sheets between each of said offset duplicator heads to thereby adjust the relative positions of said sheets and said image.

16. A process color sheet printing duplicator in accordance with claim 15 wherein said adjusting means includes screw-threaded means.

17. A process color offset printing duplicator in accordance with claim 13 wherein said vertical registration means is disposed proximate to said impression cylinder and at the forward end of said delivery table for controlling the transmission of said sheets to said impression and blanket cylinders for the application of said image thereto.

* * * * *